US012540792B2

(12) United States Patent
Hall et al.

(10) Patent No.: US 12,540,792 B2
(45) Date of Patent: Feb. 3, 2026

(54) STABILIZED END CAP FOR COMMON LAUNCH TUBE

(71) Applicant: Government of the United States, as represented by the Secretary of the Air Force, Wright-Patterson AFB, OH (US)

(72) Inventors: Andrew Hall, Troy, OH (US); John Revilla, Beavercreek, OH (US); Joshua Wiseman, Franklin, OH (US); Kelsey Snively, Dayton, OH (US); Matthew Hall, Troy, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 101 days.

(21) Appl. No.: 18/380,234

(22) Filed: Oct. 16, 2023

(65) Prior Publication Data

US 2024/0337463 A1 Oct. 10, 2024

Related U.S. Application Data

(60) Provisional application No. 63/428,129, filed on Nov. 28, 2022.

(51) Int. Cl.
*F41F 3/077* (2006.01)

(52) U.S. Cl.
CPC ..... *F41F 3/077* (2013.01)

(58) Field of Classification Search
CPC ..... F41F 3/077
See application file for complete search history.

(56) References Cited

U.S. PATENT DOCUMENTS

| | | | | |
|---|---|---|---|---|
| 3,962,951 | A * | 6/1976 | Schenk | F41F 3/077 89/1.817 |
| 4,389,938 | A * | 6/1983 | Sigrist | F41F 3/042 102/342 |
| 4,455,917 | A * | 6/1984 | Shook | F41F 3/077 89/1.817 |
| 5,269,514 | A | 12/1993 | Adler et al. | |
| D361,811 | S | 8/1995 | Grimm et al. | |
| D386,223 | S | 11/1997 | Imai | |
| 6,010,419 | A | 1/2000 | Rappaport et al. | |
| 6,042,494 | A | 3/2000 | Rappaport | |
| 6,220,918 | B1 | 4/2001 | Laronge | |
| 6,311,604 | B1 * | 11/2001 | Foris | F41F 3/077 89/1.817 |
| 6,669,587 | B2 | 12/2003 | Kessler | |
| D562,411 | S | 2/2008 | Jones et al. | |

(Continued)

*Primary Examiner* — Michelle Clement
(74) *Attorney, Agent, or Firm* — AFMCLO/JAZ; Jeffrey V. Bamber

(57) ABSTRACT

A stabilized end cap for covering one end of a common launch tube on a military aircraft is disclosed. The stabilized end cap includes a central body having a portion with a disk-shape configuration. In some cases, the stabilized end cap has a peripheral extension that extends radially outward from the periphery of the central body, and the peripheral extension is provided with an aerodynamic configuration. In other cases, the stabilized end cap has at least one aerodynamic extension extending longitudinally outward from the outside surface of the central body.

11 Claims, 5 Drawing Sheets

(56) References Cited

U.S. PATENT DOCUMENTS

| | | | | |
|---|---|---|---|---|
| 7,506,572 | B1 * | 3/2009 | Hombeck | F42B 14/06 89/31 |
| 7,520,204 | B2 * | 4/2009 | Williams | F41F 3/077 428/156 |
| 7,685,920 | B2 * | 3/2010 | Paul | F41F 3/077 89/1.817 |
| 8,256,340 | B2 * | 9/2012 | Bohs | F41F 3/077 89/1.816 |
| D889,056 | S | 6/2020 | Steinkraus | |
| 11,808,557 | B2 * | 11/2023 | Do | F42B 39/20 |
| 12,117,264 | B2 * | 10/2024 | Merems | F41F 3/077 |
| 2004/0083878 | A1 * | 5/2004 | Paul | F41F 3/077 89/1.817 |
| 2005/0183321 | A1 * | 8/2005 | Brown | F41F 3/077 42/96 |
| 2011/0126474 | A1 * | 6/2011 | Snediker | F42B 39/00 277/606 |

* cited by examiner

STABILIZED END CAP FOR COMMON LAUNCH TUBE

Pursuant to 37 C.F.R. § 1.78 (a) (4), this application claims the benefit of and priority to prior filed Provisional Application Ser. No. 63/428,129 filed Nov. 28, 2022, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to aircraft weapon systems and, more particularly, to end caps for common launch tubes on military aircraft.

BACKGROUND OF THE INVENTION

Common Launch Tubes (CLT) are designed to allow numerous aircraft to store and/or launch various weapons, unmanned aerial vehicles (UAVs), and stores. The term "stores" refers to a device intended for internal or external carriage and mounted on aircraft suspension and release equipment, whether or not the item is intended to be separated or released from the aircraft (e.g., bombs, missiles, fuel tanks, targeting pods, refueling pods, etc.) Prior to launching weapons, and the like, the exposed CLT end is typically covered with an aluminum cap. This cap is an expendable item that, and once launched, is pushed into the free stream air. The flight of this cap is not controlled and has been demonstrated to be erratic upon ejection, leading to a possible host aircraft strike. This is particularly a concern for wing-mounted CLT's on pusher-prop aircraft.

Therefore, a need exists for improved end caps for common launch tubes that are less likely to strike the host aircraft when they are launched.

SUMMARY OF THE INVENTION

The present invention relates generally to aircraft weapon systems and, more particularly, to end caps for common launch tubes on military aircraft.

While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, an end cap for covering an opening on one end of a common launch tube on a military aircraft is provided. The end cap comprises:

a central body comprising a portion with a disk-shape configuration, said central body having an inside surface for facing the opening of a common launch tube, an outside surface for facing outside the common launch tube, a center, and a periphery, wherein the periphery of the central body is sized and configured to fit adjacent to the end opening of a common launch tube; and a peripheral extension extending radially outward from the periphery of said central body in a direction away from the center of the central body, wherein the peripheral extension is provided with an aerodynamic configuration.

According to another embodiment the end cap comprises:

a central body comprising a portion with a disk-shape configuration, said central body having an inside surface for facing the opening of a common launch tube, an outside surface for facing outside the common launch tube, a center, a central axis passing through the center, and a periphery, wherein the periphery of the central body is sized and configured to fit adjacent to the end opening of a common launch tube; and at least one aerodynamic extension extending outward from the outside surface of the central body in the direction of the central axis of the central body, wherein the extension is provided with an aerodynamic configuration.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity of illustration.

DETAILED DESCRIPTION OF THE INVENTION

The present invention relates generally to aircraft weapon systems and, more particularly, to end caps for common launch tubes on military aircraft.

Figure 1:
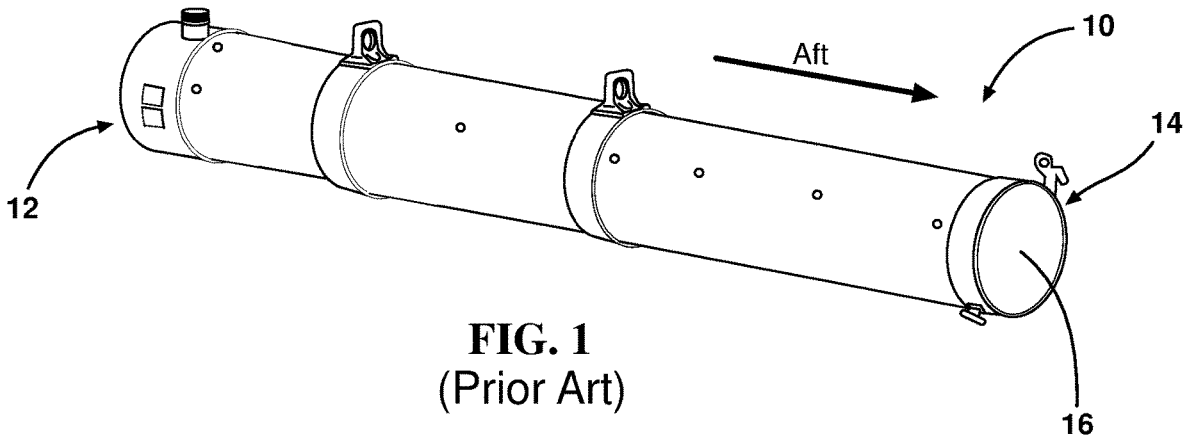
FIG. 1 (Prior Art)
FIG. 1 is a perspective view of a common launch tube.

FIG. 1 shows a common launch tube (CLT) 10 used to store and launch articles or vehicles such as various weapons, unmanned aerial vehicles (UAVs), and stores from military aircraft. The common launch tube 10 may be oriented so that it has a front (or fore) end 12 and a rear (or aft) end 14. In such cases, the weapons may be launched from either the front end or the aft end of the CLT. In other cases, the common launch tube 10 may be oriented so that it has a sideways ejection configuration (in which case the CLT will be oriented at an angle to a line extending between the fore and aft portions of an aircraft). Prior to launch, the end from which the article will be launched is typically covered with an aluminum cap 16 such as that shown in FIG. 2. The other end of the CLT will be closed.

Figure 2:
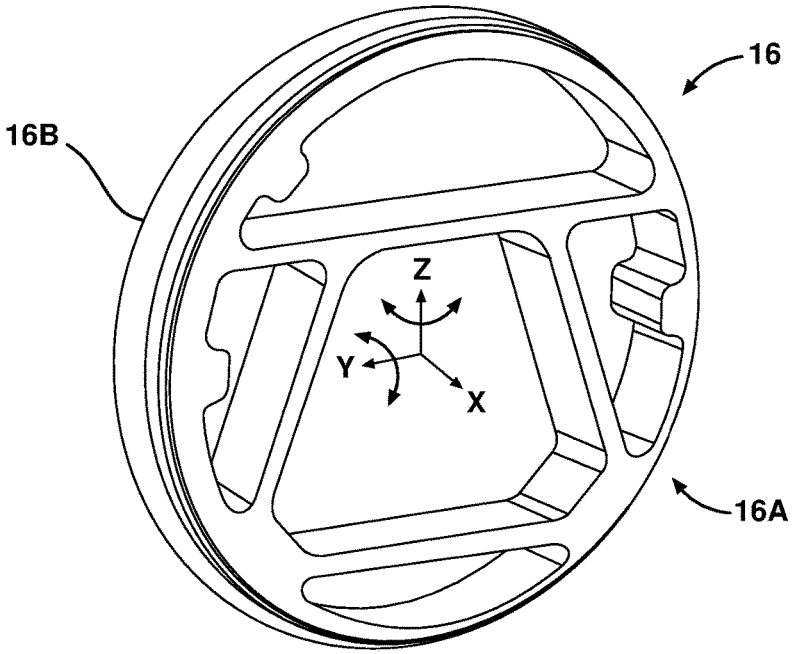
FIG. 2 (Prior Art)
FIG. 2 is a perspective view of a prior art end cap for a common launch tube.

FIG. 2 shows a prior art end cap 16 for a common launch tube. The end cap 16 functions as an environmental seal and support bulkhead for CLT vehicles prior to vehicle separation during employment. It is a circular disk, approximately six to seven inches in diameter, one inch thick, and is made of about one pound of aluminum. The inside 16A of the cap supports the CLT vehicle and the outside of the cap 16B is open to the air stream. This cap is an expendable item that, and once the article is launched, it is pushed into the free air stream. The configuration of this cap 16 is such that the flight of this cap is not controlled and has been demonstrated to be erratic upon ejection, leading to a possible host aircraft strike. While this may be a concern for all types of host aircraft, this is particularly a concern for striking the propellers in the cases of wing-mounted rear-firing CLT's on pusher-prop aircraft.

Figure 3:
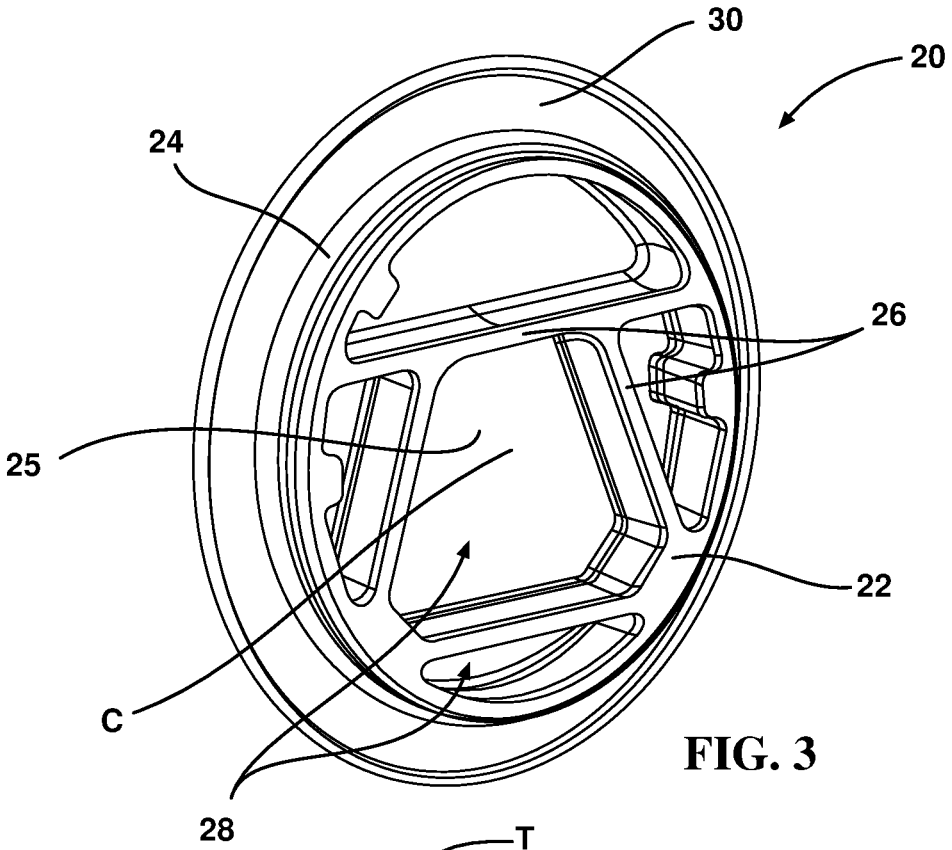
FIG. 3 is a perspective view of one embodiment of an end cap comprising a peripheral lip in the configuration of an air foil.
Figure 3A:
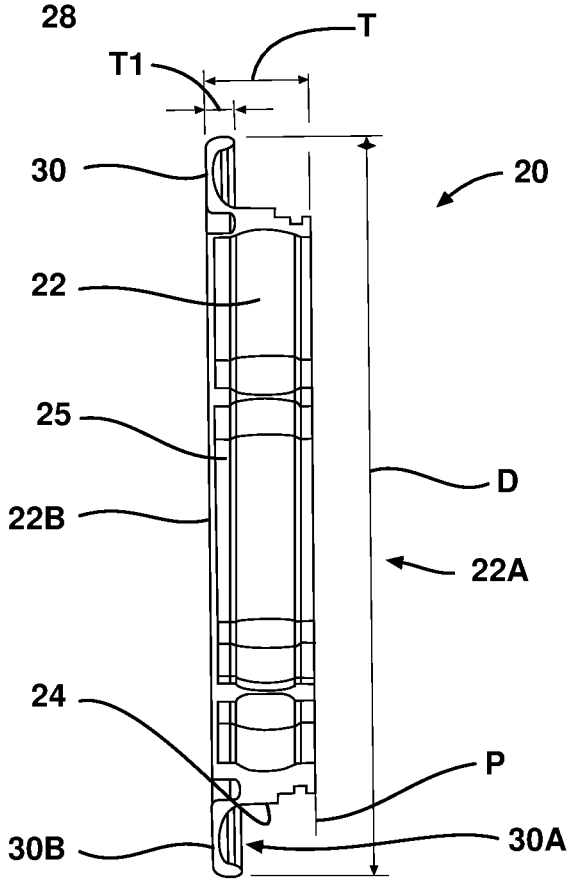
FIG. 3A is a cross-section view the end cap shown in FIG. 3 taken along line 3A-3A of FIG. 3.

FIGS. 3 and 3A show a first embodiment of a stabilized end cap 20 for a common launch tube according to the present invention. The stabilized end cap 20 comprises a central body 22 having an inside surface 22A, an outside surface 22B, a center C, and a periphery (or outer perimeter) 24. The central body 22 may have a circular plan view configuration. The central body 22 may comprise a portion with a disk-shape configuration that may be in the form of a generally planar circular element 25. The central body 22 may have an overall thickness T, which may be about 1 inch. The central body 22 may comprise one or more structural members 26 on its inside surface 22A. The central body 22 may have recessed areas 28 that are located between the structural members 28 on the inside surface 22A of the central body 22. The recessed areas 28 are recessed relative to an imaginary plane P placed against outermost portions of the inside surface 22A of the central body 22. The outside surface 22B of the central body 22 may be generally planar. The generally planar circular element 25 may form the outside surface 22B of the central body 22 and bottom of the recessed areas 28 of the central body 22. This circular element 25 has a thickness that is less than the overall thickness T of the central body 22. The periphery 24 of the central body 22 may be in the form of a ring-shaped (or short cylindrical) structure that extends perpendicularly to the inside surface of the generally planar circular element 25. The periphery 24 of the central body 22 may be sized and configured to fit inside the end opening of a common launch tube.

In the embodiment shown in FIGS. 3 and 3A, the stabilized end cap 20 comprises a peripheral extension (or "peripheral lip") 30 that is joined to the periphery 24 of the central body 22. The peripheral extension 30 may be an extension of the generally planar circular element 25. The peripheral extension 30 extends outward from the outer perimeter 24 in a direction away from the center C of the central body 22. References to the parts of the stabilized end cap 20 may be considered in a Cartesian coordinate system as shown in FIG. 2.

The peripheral extension 30 may be generally in the configuration of a ring such as an annular ring that surrounds the central body 22. The peripheral extension 30 has an inwardly-facing surface 30A and an outwardly-facing surface 30B. The outwardly-facing surface 30B may be an extension of the outside surface 22B of the central body 22. The peripheral extension 30 (and the generally planar circular element 25) may have a thickness Tl that may be less than or equal to about one-half the overall thickness T of the central body 22. In some cases, the peripheral extension 30 (and the circular element) may have a thickness Tl that may be less than or equal to about one-fourth the overall thickness T of the central body 22. The peripheral extension 30 is provided with an aerodynamic configuration (that is, it is in the configuration of an air foil). More specifically, the inwardly-facing surface 30A of the peripheral extension 30 is in the configuration of a channel with a concave cross-section surrounding the central body 22.

The stabilized end cap 20, and the portions thereof, can have any suitable dimensions. In some cases, the central body 22 of the stabilized end cap 20 may have a diameter of 6.125 inches. The peripheral extension 30 may have any suitable width. In some cases, the peripheral extension 30 may be about 0.75 inches in width giving the stabilized end cap 20 an overall diameter D of 7.625 inches. The peripheral extension 30 may or may not extend beyond the outer sides of the common launch tube.

There are numerous, non-limiting embodiments of the stabilized end cap. All embodiments, even if they are only described as being "embodiments" of the invention, are intended to be non-limiting (that is, there may be other embodiments in addition to these), unless they are expressly described as limiting the scope of the invention. Any of the embodiments described herein can also be combined with any other embodiments in any manner to form still other embodiments.

Figure 4:
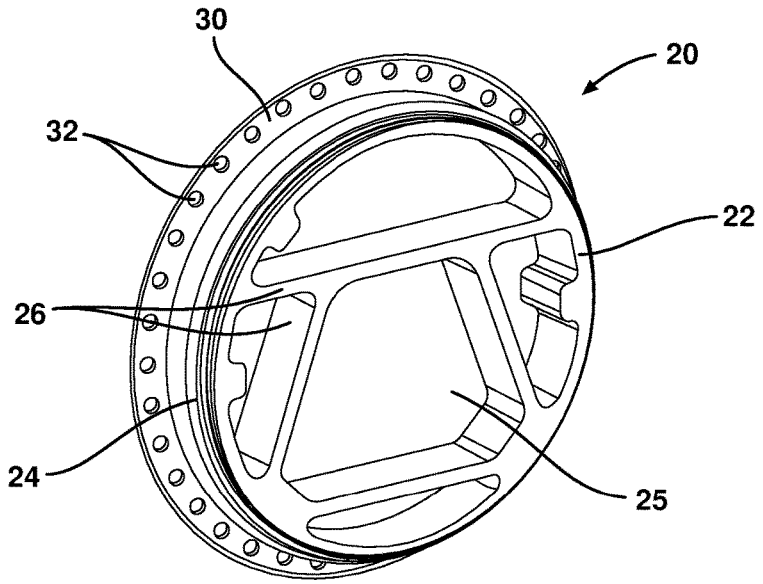
FIG. 4 is a perspective view of another embodiment of an end cap comprising a high drag peripheral lip.

FIG. 4 shows a second embodiment of a stabilized end cap 20. The second embodiment (and the other embodiments described herein) may have a central body 22 with any of the properties described above. In this embodiment, the end cap 20 comprises a high drag peripheral lip. This embodiment of the end cap 20 may have a peripheral lip 30 similar to the first embodiment shown in FIGS. 3 and 3A. However, the peripheral lip 30 is provided with a plurality of spaced apart openings 32 therein. There can be any suitable number of openings 32. The openings 32 can be distributed around the entire peripheral lip 30. The openings can be of any suitable number, size, and configuration. Suitable configurations include circular openings.

Figure 5:
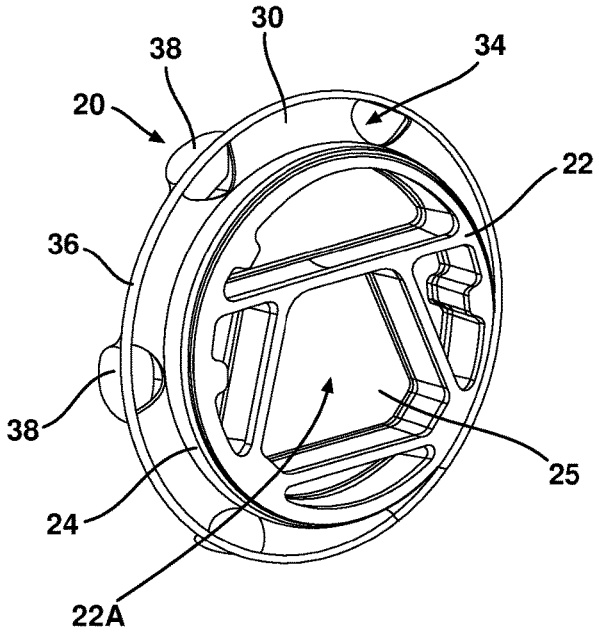
FIG. 5 is a perspective view of another embodiment of an end cap comprising a hybrid airfoil-lip.
Figure 5A:
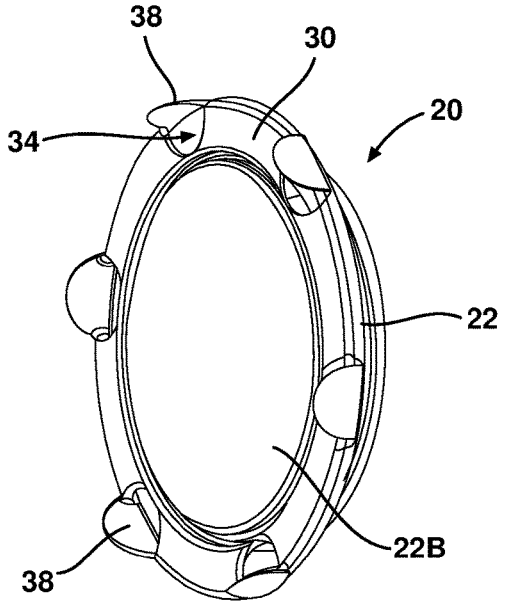
FIG. 5A is a perspective view of the end cap shown in FIG. 5, taken from another angle.

FIGS. 5 and 5A show a third embodiment of a stabilized end cap 20. This embodiment of the end cap 20 may have a peripheral lip 30 similar to the first and second embodiments. This embodiment has a lip 30 with a plurality of spaced apart openings (or holes) 34 therein that are distributed around portions of the perimeter thereof. The openings 34 can be of any suitable number, size, and configuration. In the embodiment shown, there are six openings 34 equally spaced radially around the lip 30, and the openings 34 may have a semi-circular configuration. In addition, the lip 30 is provided with an outermost edge 36 having a plurality of fins 38 joined thereto that extend rearwardly therefrom adjacent the location of each of the holes 34. The fins 38 may be of any suitable number, shape, size, and orientation. In the embodiment shown, there are six fins, and the fins 38 are in the shape of the semi-circular material displaced to form the openings 34 in the lip 30. The fins 38 may be oriented tangentially to the perimeter 36 of the peripheral lip 30 adjacent the locations of each opening 34.

Figure 6:
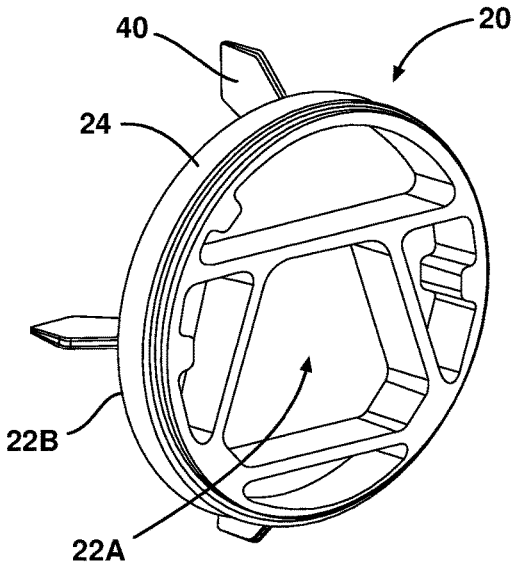
FIG. 6 is a perspective view of another embodiment of an end cap comprising a plurality of tail strakes.
Figure 6A:
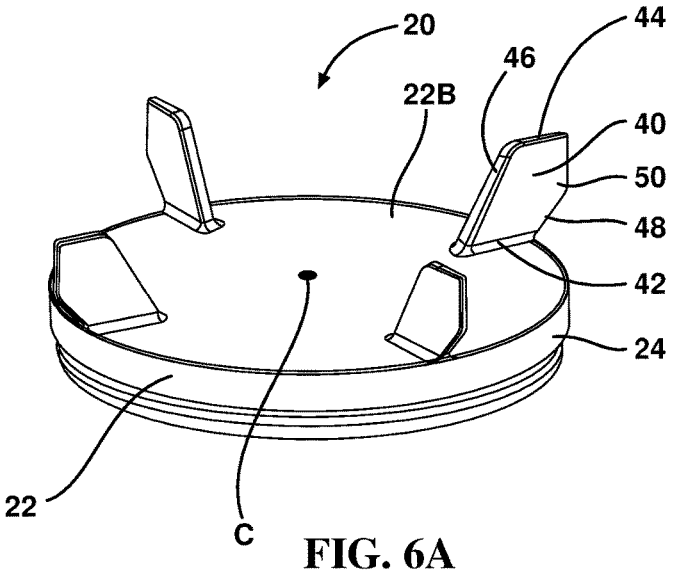
FIG. 6A is a perspective view of the end cap shown in FIG. 6, taken from another angle.

FIGS. 6 and 6A show a fourth embodiment of a stabilized end cap 20. In this embodiment, the end cap 20 comprises at least one extension 40 extending longitudinally outward from the outside surface 22B of the central body 22 in a direction perpendicular to the outside surface 22B. The extension 40 is provided with an aerodynamic configuration. More specifically, the at least one extension comprises a plurality of fins or tail strakes 40. The fins 40 have proximal edges 42, distal edges 44, inner edges 46, and outer edges 48. The proximal edges 42 of the fins 40 are joined to the outside surface 22B of the central body 22. The fins 40 have a width and a longer dimension that extends between the inner and outer edges 46 and 48, respectively. There can be any suitable number of fins 40 and they can be in any suitable location. In this embodiment, there are four fins 40, and they are spaced apart and distributed radially around the periphery of the central body 22. The fins 40 are oriented so that their longer dimensions extend toward the center C of the central body 22. A portion of the tail 50 of each of the fins 40 extends radially outward beyond the periphery 24 of the central body 22.

Figure 7:
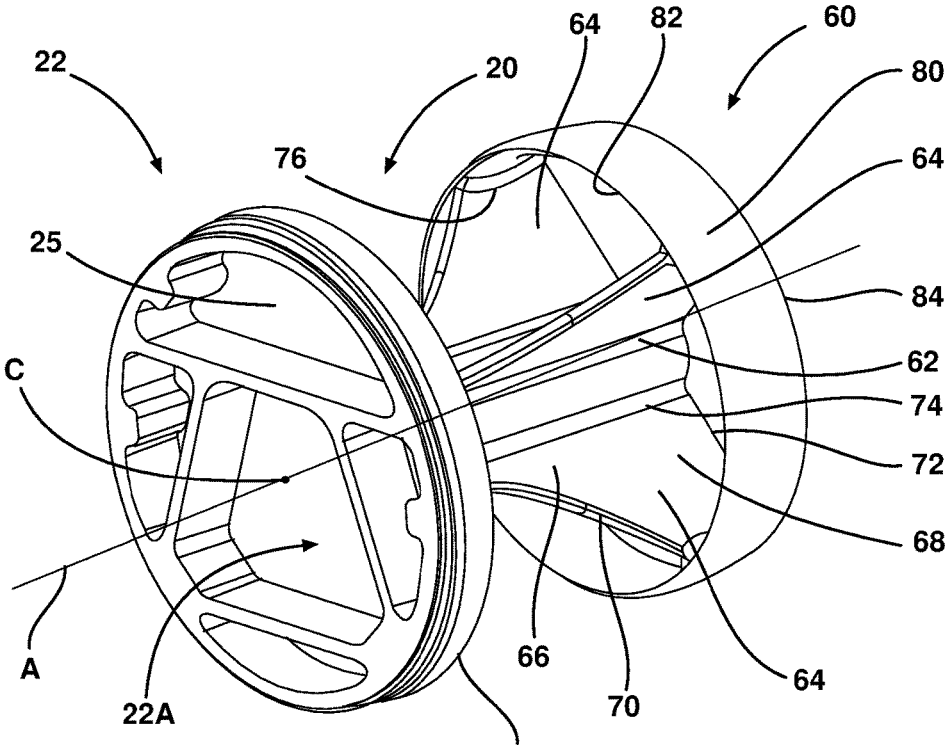
FIG. 7 is a perspective view of another embodiment of an end cap comprising a concentric tail fin with a large air foil.

FIG. 7 shows a fifth embodiment of a stabilized end cap 20. In this embodiment, the end cap 20 comprises comprising a concentric tail fin 60 with a large air foil. More specifically, the tail fin 60 comprises an elongated central member 62 that is joined to the outside surface 22B at the center C of the central body 22. The central member 62 extends in a direction perpendicular to the outside surface 22B. The central member 62 may have any suitable configuration. In this embodiment, the central member 62 is generally cylindrical. The central member 62 has a longitudinal axis A. The central member 62 has a plurality of fins 64 joined thereto that extend in the direction of the longitudinal axis A of the central member 62. The fins 64 may be of any suitable number, shape, and size.

In the embodiment shown, there are four fins 64 that are spaced every 90° around the central member 62. The fins 64 have a fore portion 66, an aft portion 68, a leading edge 70, a trailing edge 72, an inner edge 74, and an outer edge 76. The inner edges 74 of the fins 64 are joined to the central member 62 and extend along the longitudinal axis A thereof. The fore portions 66 of the fins may be adjacent to the inner edges 74 thereof and may have a relatively smaller dimension extending radially outward from the central member 62. The aft portions 68 of the fins 64 are much larger than the fore portions and extend outward from the central member. The aft portions of the fins may extend radially outward a distance that may be any of the following: slightly less than the diameter of the central body 22, equal to the diameter of the central body 22, or greater than the diameter of the central body. In the embodiment shown, the trailing edges 72 of the fins 64 are rectilinear and are oriented perpendicular to the central member 62. The leading edges 70 of the fins 64 may have any suitable configuration. In the embodiment show, the leading edges 70 of the fins 64 may have a curvilinear concave configuration when viewed from the side. A circular ring 80 is joined to the outer edges 76 of the fins 64 at the aft portions thereof. The circular ring 80 has a leading edge 82, a trailing edge 84, an inside surface, and an outside surface. The leading edge 82 of the ring 80, and optionally the trailing edge 84, may be tapered so that they are more aerodynamic.

Figure 8:
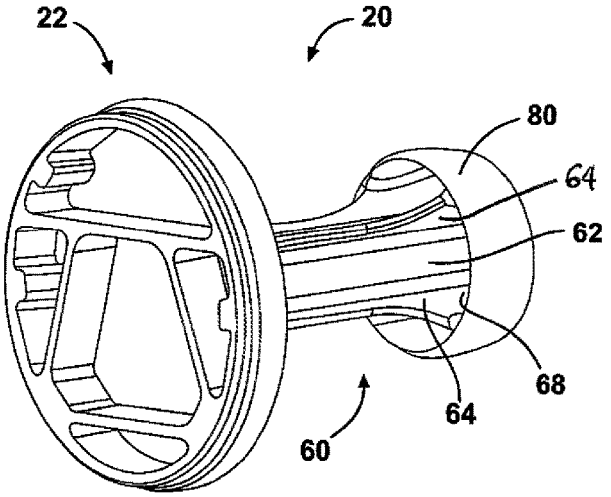
FIG. 8 is a perspective view of another embodiment of an end cap comprising a concentric tail fin with a small air foil.

FIG. 8 shows a sixth embodiment of an end cap 20 comprising a concentric tail fin 60 with a small air foil. The sixth embodiment is similar to the fifth embodiment. The main difference between the fifth and sixth embodiments is that fins 64 and circular ring 80 of the sixth embodiment have much smaller dimensions so that the aft portions of the fins 68 extend radially outward a distance that is considerably less than the diameter of the central body 22.

Figure 9:
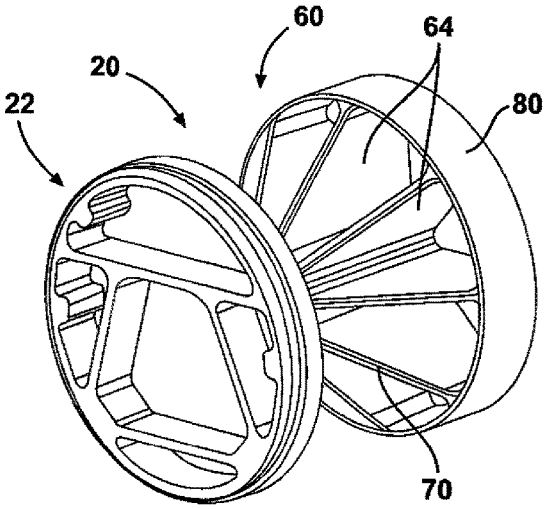
FIG. 9 is a perspective view of another embodiment of an end cap comprising a concentric tail fin with a plurality of fins.
Figure 9A:
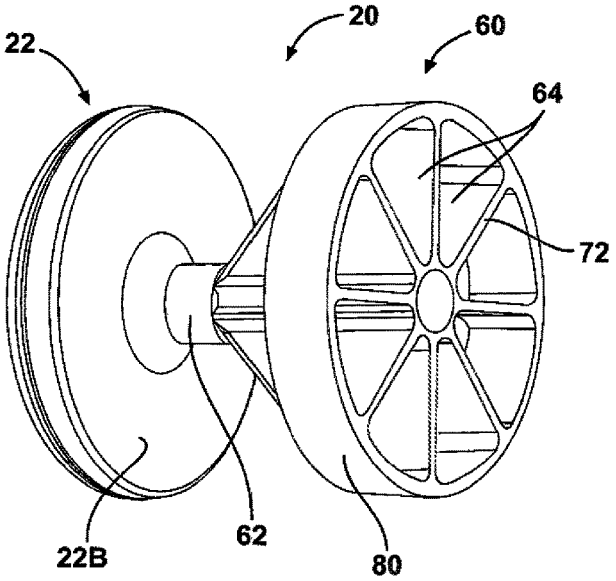
FIG. 9A is a perspective view of the end cap shown in FIG. 9, taken from another angle.

FIGS. 9 and 9A show a seventh embodiment of an end cap 20 comprising a concentric tail fin with a plurality of fins. The seventh embodiment is similar to the fifth embodiment as well. The main differences between the fifth and seventh embodiments are: the central member 62 of the seventh embodiment is shortened; the seventh embodiment has eight fins instead of four; and the leading edges 70 of the fins 64 of the seventh embodiment are rectilinear when viewed from the side (instead of being curvilinear).

Any of the embodiments described herein could also be configured to provide at least some portion of the periphery 24 of the central body 22 that is sized and configured to fit around the outside of the common launch tube 10 at the end opening of the common launch tube.

The stabilized end cap 20 can be manufactured in any suitable manner from any suitable materials. The stabilized end cap 20 can be additively manufactured, machined, or cast/molded out of a variety of metallic and plastic materials. In some embodiments, the stabilized end cap may be made by additive printing followed by finish machining and optional surface coating.

The stabilized end cap 20 can be used as follows. The stabilized end cap 20 is mounted in the common launch tube 10 and retained by two shear screws. During the common launch tube employment, the common launch tube vehicle is ejected from the tube, shearing the cap retaining screws and expending the cap 20 into the free airstream. The stabilized end cap 20 reduces tumbling and rotation resulting in a more stable and predictable trajectory.

The stabilized end caps described herein can provide a number of advantages. It should be understood, however, that these advantages need not be required unless they are set forth in the appended claims. The present invention provides improved end caps for common launch tubes with a more predictable trajectory that are less likely to strike the host aircraft when they are launched. The ejected behavior of the modified caps is more stable, and reduces or eliminates spins and increases host aircraft clearance. The end caps are particularly suitable for wing-mounted common launch tubes on pusher-prop aircraft, but can also be used on common launch tubes mounted on aircraft with forward-propeller and turbine engines.

The terms "join" and "joined", as used herein, encompass configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined" includes both those configurations in which an element is temporarily joined to another element, or in which an element is permanently joined to another element.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. An end cap for covering an opening on one end of a common launch tube on a military aircraft, the common launch tube having an interior for housing an article which is to be deployed from the common launch tube, said end cap comprising:

a central body comprising a portion with a disk-shape configuration, said central body having an inside surface for facing the opening of a common launch tube, an outside surface for facing outside the common launch tube, a center, and a periphery, wherein the periphery of the central body is sized and configured to fit adjacent to the end opening of a common launch tube; and a peripheral extension extending radially outward from the periphery of said central body in a direction away from the center of said central body, wherein said peripheral extension is provided with an aerodynamic configuration, wherein the central body and the peripheral extension of the end cap are joined together and are configured to be pushed into the free stream air as a single unit when separated from the common launch tube.

2. The end cap of claim 1 wherein the peripheral extension is in the form of a lip in the configuration of an air foil.

3. An end cap for covering an opening on one end of a common launch tube on a military aircraft, the common launch tube having an interior for housing an article which is to be deployed from the common launch tube, said end cap comprising:

a central body comprising a portion with a disk-shape configuration, said central body having an inside surface for facing the opening of a common launch tube, an outside surface for facing outside the common launch tube, a center, and a periphery, wherein the periphery of the central body is sized and configured to fit adjacent to the end opening of a common launch tube; and a peripheral extension extending radially outward from the periphery of said central body in a direction away from the center of said central body, wherein said peripheral extension is provided with an aerodynamic configuration, wherein the peripheral extension is in the form of a lip in the configuration of an air foil, and the lip has an inwardly-facing surface that is in the configuration of a channel with a concave cross-section surrounding the central body, wherein said lip has an outside surface that is an extension of the outside surface of the central body.

4. The end cap of claim 2 wherein the lip has a plurality of holes therein that are distributed around the perimeter thereof.

5. An end cap for covering an opening on one end of a common launch tube on a military aircraft, the common launch tube having an interior for housing an article which is to be deployed from the common launch tube, said end cap comprising:

a central body comprising a portion with a disk-shape configuration, said central body having an inside surface for facing the opening of a common launch tube, an outside surface for facing outside the common launch tube, a center, and a periphery, wherein the periphery of the central body is sized and configured to fit adjacent to the end opening of a common launch tube; and a peripheral extension extending radially outward from the periphery of said central body in a direction away from the center of said central body, wherein said peripheral extension is provided with an aerodynamic configuration, wherein the peripheral extension is in the form of a lip in the configuration of an air foil, and the lip has a plurality of holes therein that are distributed around portions of the perimeter thereof, and the lip is provided with an outermost edge having a plurality of fins extending rearwardly therefrom adjacent the location of each of said holes.

6. An end cap for covering an opening on one end of a common launch tube on a military aircraft, the common launch tube having an interior for housing an article which is to be deployed from the common launch tube, said end cap comprising:

a central body comprising a portion with a disk-shape configuration, said central body having an inside surface for facing the opening of a common launch tube, an outside surface for facing outside the common launch tube, a center, a central axis passing through the center, and a periphery, wherein the periphery of the central body is sized and configured to fit adjacent to the end opening of a common launch tube; and at least one aerodynamic extension extending outward from the outside surface of the central body in the direction of the central axis of the central body, wherein said extension is provided with an aerodynamic configuration.

7. The end cap of claim 6 wherein the aerodynamic extension comprises a plurality of tail strakes that are spaced apart and distributed radially around the periphery of the central body, wherein said tail strakes have a longer dimension, and are oriented so that their longer dimensions extend toward the center of the central body, and a portion of the tail of each of the tail strakes extends radially outward beyond the periphery of the central body.

8. The end cap of claim 6 wherein the aerodynamic extension comprises an elongated central member that is joined to the outside surface at the center of the central body, which central member has a longitudinal axis and extends in a direction perpendicular to the outside surface, wherein a plurality of fins are joined to the central member extend in the direction of the longitudinal axis of the central member, wherein said fins have a fore portion, an aft portion, a leading edge, a trailing edge, an inner edge, and an outer edge, wherein said fins are joined at their inner edges to said central member and extend outward therefrom to their outer edges.

9. The end cap of claim 8 further comprising a circular ring joined to the outer edges of the fins at the aft portions of said fins.

10. The end cap of claim 9 wherein said central body has a diameter and said circular ring has a diameter, wherein the diameter of the circular ring is greater than or equal to the diameter of the central body.

11. The end cap of claim 9 wherein said central body has a diameter and said circular ring has a diameter, wherein the diameter of the circular ring is less than the diameter of the central body.

* * * * *